United States Patent [19]

Alexandrov et al.

[11] 3,965,968

[45] June 29, 1976

[54] DEVICE FOR CENTRIFUGAL CASTING OF HOLLOW BODY WITH ASYMMETRICAL CROSS-SECTION

[76] Inventors: Nikolai Nikitievich Alexandrov, Sharikopodshipnikovskaya ulitsa, 2, kv. 126; Nikolai Nikolaevich Zorev, ulitsa Novinki, 6, kv.; Viktor Mikhailovich Krapukhin, Suvorovsky bulvar, 15, kv. 13; Viktor Vasilievich Krotov, Obolensky pereulok, 7, kv. 110; Ivan Romanovich Kryanin, Sharikopodshipnikovskaya ulitsa, 2, kv. 68; Boris Samoilovich Milman, Sharikopodshipnikovskaya ulitsa, 2, kv. 89; Pavel Vladimirovich Semenov, Nagatinskaya ulitsa, 95, kv. 62; Nikolai Anatolievich Sokolov, Sharikopodshipnikovskaya ulitsa, 2, kv. 160; Viktor Gurievich Tinyakov, Juzhno-Portovaya ulitsa, 16, kv. 23, all of Moscow, U.S.S.R.

[22] Filed: Dec. 24, 1974

[21] Appl. No.: 536,310

[30] Foreign Application Priority Data

Jan. 2, 1974 U.S.S.R. ..... 1981019

[52] U.S. Cl. ..... 164/287; 164/293; 425/425

[51] Int. Cl.[2] ..... B22D 13/04

[58] Field of Search ..... 164/287, 293; 425/425

[56] References Cited

UNITED STATES PATENTS 2,451,103 10/1948 Loew ..... 164/287

FOREIGN PATENTS OR APPLICATIONS 14,774 10/1933 Australia ..... 164/287

422,181 10/1933 United Kingdom ..... 164/293

*Primary Examiner*—Robert D. Baldwin

*Attorney, Agent, or Firm*—Haseltine, Lake & Waters

[57] ABSTRACT

A device adapted for the production of a hollow body with an extension in a built-up metal mould provided with lining. The spinning axis of the built-up metal mould is essentially coaxial with the mould longitudinal axis owing to which the filling of the cavity provided in said mould with molten metal causes a progressing unbalance of the device. For offsetting this unbalance provision is made for a movable weight travelling radially to the spinning axis of said metal mould as the unbalance is being progressed.

1 Claim, 7 Drawing Figures

DEVICE FOR CENTRIFUGAL CASTING OF HOLLOW BODY WITH ASYMMETRICAL CROSS-SECTION

The present invention relates to centrifugal casting equipment and more particularly to a device for the centrifugal casting of a hollow body with asymmetrical cross-section, such a configuration involving an unbalance caused by unbalanced centrifugal forces originating in the spinning of a foundry mould.

The present invention may prove to be most advantageous in casting a relatively heavy body with a large extension portion, such as axle boxes for rolling stock, branch fittings for pipe lines, etc.

It is common knowledge that unbalanced centrifugal forces involve dynamic unbalance dependent on a mould spinning speed and the magnitude of statically unbalanced masses. The unbalance exceeding the value permissible for a particular casting device disturbs its operation and may cause failure of a foundry mould or of the device proper.

Insofar as the spinning speed of a foundry mould is determined by the requirements to the casting, attempts made so far at decreasing the dynamic unbalance value or that of the extent of its adverse effect on the device, even if not futile, were based on a considerable increase in the weight of revolving masses or in the rigidity of a shaft or other elements of the device which, as it is known, can hardly be tolerated.

Such are attempts at casting a hollow body with asymmetrical cross-section associated with the use of a foundry mould adapted for producing several such bodies simultaneously. As the above foundry mould is revolving, the bodies counterbalance each other due to their diametrically opposite location within the mould (see, e.g. an article by I. I. Nosovich "Experience in Casting Steel Fittings" published in a Soviet magazine "Shipbuilding", No. 4, 1950).

However, such practices involve considerable consumption of mould and core sands, excessive consumption of molten metal due to intricate gating, the provision of casting heads, etc. The casting of large hollow bodies demands foundry moulds and casting devices of considerable sizes, a feature which makes them economically disadvantageous.

The principal object of the present invention is the provision of a device for centrifugal casting of a hollow body with asymmetrical cross-section which would allow using a comparatively light-weight built-up metal mould with a relatively thin lining layer, said mould being adapted for producing a single hollow body by pouring each time molten metal into the mould spinning about its longitudinal axis, essentially coaxial with that of the hollow body being cast.

Said object can be achieved if the unbalance is duly compensated for immediately as it appears when the molten metal is poured into the metal mould, the compensation progressing with the progress of the unbalance in the course of filling the cavity in the mould dictated by the asymmetrical cross-section of the hollow body to be cast.

According to the present invention, the unbalance compensation is achieved by that a member of the device associated with a revolving turntable on which a metal mould is mounted carries a weight disposed diametrically opposite to the extension cavity which on being filled with molten metal causes a progressing unbalance of the device. The weight is mounted so as to move away from the spinning axis of the metal mould in accordance with the increasing unbalance. Such a movement of the weight established an unbalance cancelling force augmenting with the travel of the former.

In case the spinning speed of the base plate carrying the metal mould is adjustable, it is expedient that the member associated with the turntable mount a rod secured thereto and essentially radial to the spinning axis of the turntable, with a movable metal body acting as a weight being freely fitted on the rod. The weight is biased with a spring precluding its displacement from said spinning axis, the force developed by the spring being overcome by the weight as the spinning speed reaches a requisite value. As the cavity in the metal mould extension is being filled with molten metal causing a progressing unbalance, the spinning speed of said turntable increases, the weight moves away from the spinning axis overcoming the spring resistance and offsetting continually the unbalance.

When use is made of a built-up metal mould fastened together by centrifugal locks, it is sufficient that the mould cavity causing the unbalance be disposed diametrically opposite to one of the centrifugal locks with the lock weight being made movable along one arm of a double-arm lever carrying said weight, the lever being a mandatory member of the centrifugal lock.

The present invention does not rule out also a possibility of a positive regulation of the movable weight with the turntable carrying the metal mould revolving at a constant speed.

In one of the embodiments of the herein-proposed device the rod carrying the movable weight may be threaded, and the movable weight may be made as a nut set on said rod. Mounted at the turntable is a stationary electromagnet capable of interacting by virtue of an electromagnetic field with the movable weight within the period of filling the metal cavity with molten metal causing the unbalance. Owing to the above interaction, the movable weight travels along said threaded rod from the spinning axis offsetting thereby the unbalance.

In another embodiment of the device the rod holding the movable weight in place is advisable to be secured to a piston and said movable weight be made as a cylinder filled with fluid and accommodating said piston. In this case both cylinder spaces must communicate with one another with the communication passage being provided with a throttle uncovered at the instant molten metal is being poured into the metal mould. When the throttle is uncovered the fluid starts overflowing from the space of said cylinder adjacent the metal mould spinning axis into that (the space) remote therefrom and the cylinder itself starts moving along the rod away from the spinning axis offsetting the device unbalance.

The unbalance originating when the mould extension cavity is being filled with molten metal can be compensated for not only by radial displacement of the movable weight away from the mould spinning axis but by radial travel of the weight towards the axis. To this end the movable weight mounted on the member associated with the turntable is arranged on the same side of the spinning axis as the above mould cavity.

A device with the turntable carrying a metal mould and revolving with an adjustable speed would be most adaptable for such compensation. It is expedient that the member associated with the turntable be provided with a rod secured thereto and essentially radial to the spinning axis of said turntable with a movable metal body acting as the weight freely fitted on said rod. The weight is biased with a spring compressed by said weight as a relatively high turntable spinning speed. In this case the weight is rather considerably spaced from the spinning axis. As the mould cavity is being filled with molten metal with the ensuing progressing unbalance the spinning speed of said turntable diminishes and the weight urged by the spring moves towards the spinning axis offsetting continuously the unbalance accordingly to the filling of said cavity.

A principal advantage of the present invention resides in an about 30 – 50% decrease in molten metal requirements due to the elimination of casting heads, ingates, downgates and other elements of the gating system and smaller machining allowances owing to higher dimensional accuracy of the casting being produced. At the same time there is provided a several-fold reduction in the consumption of mould and core sands, in expenditures related to the making and handling of moulding mixtures, making and drying cores, etc.

Other objects and advantages of the invention will become more apparent from the following detailed description of its exemplary embodiments thereof, to be had with reference to the accompanying drawings, wherein.

Figure 3:
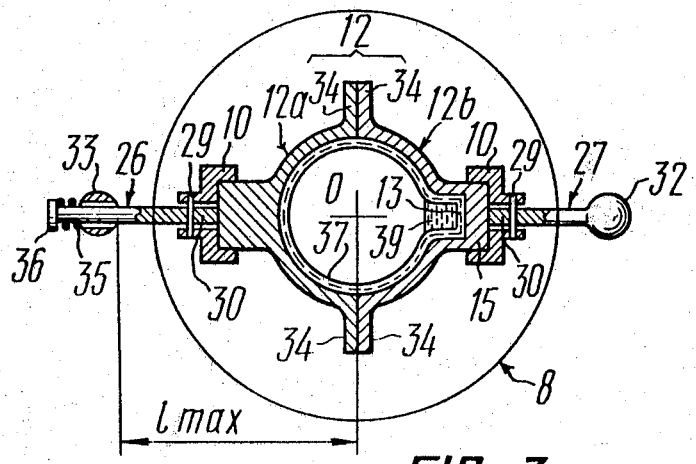
Figure 4:
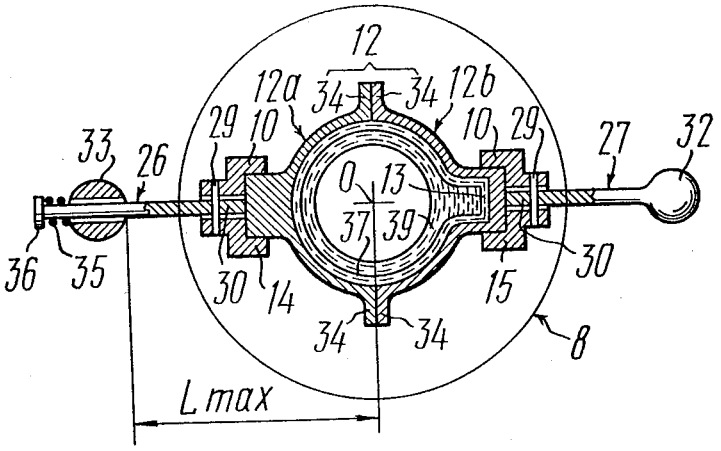
Figure 5:
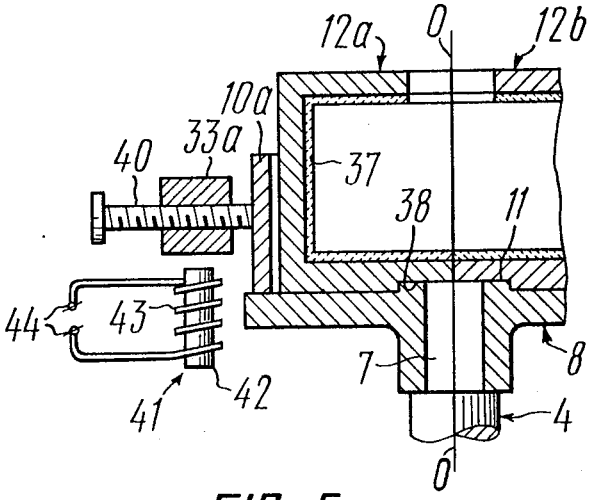
Figure 6:
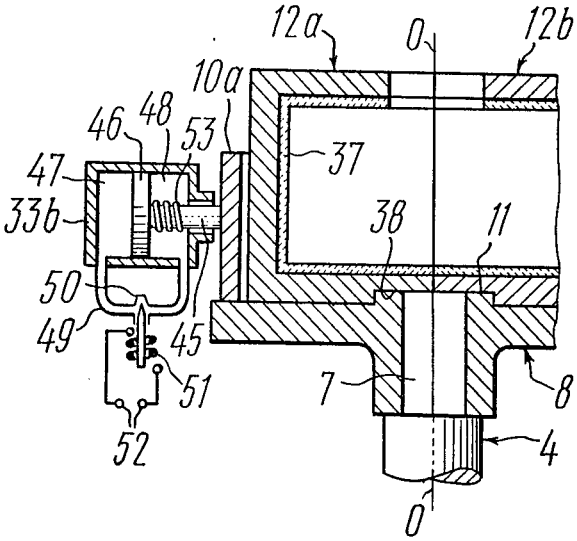
Figure 7:
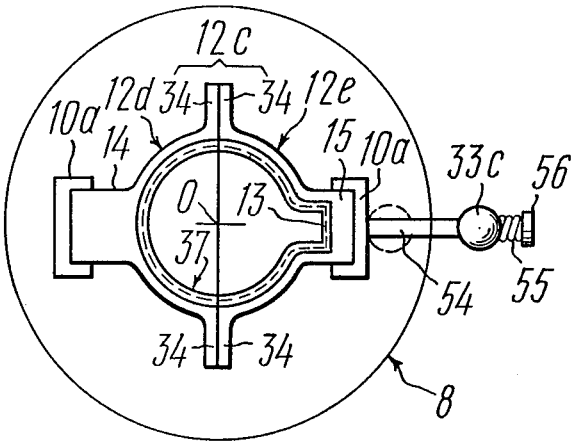

FIG. 3 - ditto at the moment the metal mould extension cavity is completely filled with molten metal;

FIG. 4 - ditto, at the moment the pouring of molten metal has come to an end;

FIG. 5 - shows an embodiment of the invention with a movable weight made as a nut (a longitudinal sectional view of the part of the proposed device);

FIG. 6 shows an embodiment of the invention with a movable weight made as a compensating cylinder (a longitudinal sectional view of the part of the device);

FIG. 7 - shows an embodiment of the invention with a movable weight disposed on the same side of the spinning axis as the cavity of the mould.

Figure 1:
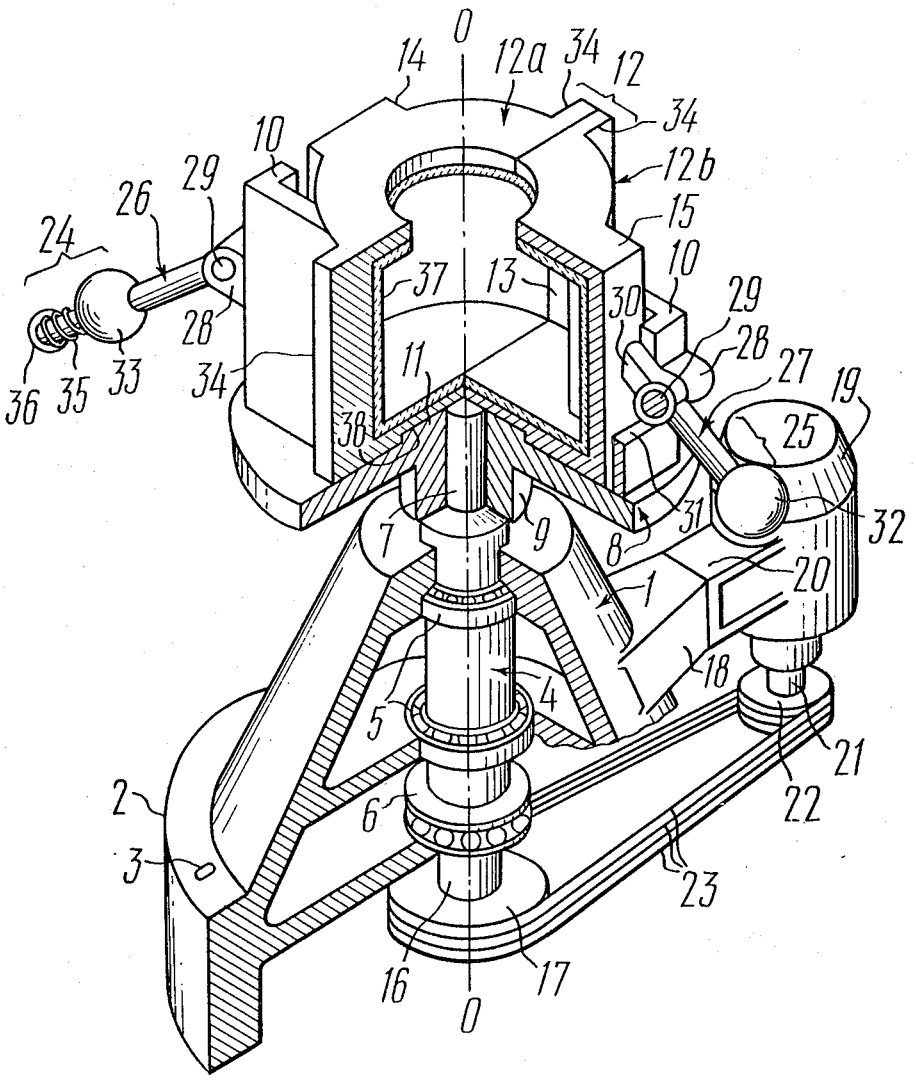
FIG. 1 is an axonometric projection with a fragmentary cutaway of the centrifugal casting device according to the invention.

A device has a fixed hollow base plate 1 (FIG. 1) provided with a flange 2 in its bottom portion, said flange having holes 3 (only one hole is shown) for securing said base plate 1 to the foundation (not shown in the drawing) with bolts (not shown). The fixed base plate accommodates a vertical shaft 4 riding in two radial roller bearings 5 and a thrust bearing 6. The top end 7 of the shaft 4 carries a turntable 8, referred to hereinafter as a disc 8, rigidly fixed thereon with the help of a key (not shown in the drawing). In the central portion of the disc 8 there is a hub 9 arranged from below and adaptable for assembling with the top end 7 of the shaft 4 by an interference fit. In the top portion of the disc 8 provision is made for diametrically opposite vertical members (10) referred to hereinafter as stays 10 with U-shaped cross-section. The stays 10 are rigidly connected to the disc 8 by welding. At the top of the disc 8 in its central portion there is a shelf 11 adaptable in combination with the stays 10 for aligning a metal mould 12 set up vertically on the disc 8. The metal mould 12 is made up of two half-moulds **12*a* and 12*b* respectively, with the latter, i.e. with the half-mould 12*b* being provided with a cavity 13 whose configuration is determined by the asymmetrical profile of a hollow body being produced, such as, axle boxes for rolling stock. To align the metal mould 12 in the stays 10 the mould 12 has extensions 14 and 15 disposed along the height of the mould 12 in its half-moulds 12*a* and 12*b*** accordingly.

Pressed on a bottom end 16 of the shaft 4 is a pulley 17 secured additionally to the shaft 4 by means of a key (not shown). A bracket 18 provided on the fixed base plate 1 mounts a means 19 referred to hereinafter as a D.C. electric motor 19 rigidly fixed thereto with the aid of a flange 20 and bolts (the latter are not shown in the drawing). Pressed on the shaft 21 of the electric motor 19 is a pulley 22 fastened additionally to the shaft 21 by means of a key (not shown). Belts 23 placed on the pulley 17 and 22 are adapted to transmit the rotation of the shaft 21 of the electric motor 19 to the vertical shaft 4 carrying the disc 8 which acts as a revolvable turntable of the metal mould 12 mounted on said disc 8.

Centrifugal locks 24 and 25 set up on the stays 10 are adapted to hold the half-moulds **12*a* and 12*b* tight to each other when the disc 8 is in rotation. Each of the centrifugal locks 24 and 25 is provided with an inclined double-arm lever 26 and 27 accordingly set up with the help of pivots 29 in eyes 28 disposed in the top portion of each stay 10. The top end 30 of each double-arm lever 26 and 27 extends into an opening 31 provided in each of the stays 10 and strikes against the wall of the mould halves 12*a* and 12*b*.**

The bottom end of the double-arm lever 27 is a rod arranged radially in plan to the spinning axis 00 of the disc 8. It mounts a metal body acting as a weight 32 fixed to or made integral with the rod. The bottom end of the double-arm lever 26 carries a movable metal body — a weight 33 fitted freely thereon. When the disc 8 is in rotation, the metal bodies 32 and 33 are brought apart due to centrifugal forces, the double-arm levers 26 and 27 turning, as a result, on their pivots 29 to occupy a horizontal position. The top ends 30 of the double-arm levers 26 and 27 acting accordingly on the half-moulds **12*a* and 12*b* hold them tight to one another by which virtue the built-up metal mould 12 is fastened together when the disc 8 is in rotation. Reliable sealing of the joint between the half-mould 12*a* and 12*b* is obtained due to relatively large projections 34 on the mould 12 along its height, said projections 34 coming in contact in a plane located at right angles to that passing through the spinning axis 00 of the metal mould 12 (the axis being strictly or almost coaxial with the longitudinal axis of the mould 12) and through the centres of gravity of the metal bodies 32 and 33. The cavity 13 in the metal mould 12 is in diametrical opposition to the movable metal body 33.**

The movable metal body 33 is held at a prescribed distance from the bottom end of the double-arm lever 26 with the aid of a spring 35 striking with one end against said metal body 33 and with another against a boss 36 on the bottom end of the double-arm lever 28.

From within the half-moulds **12*a* and 12*b* are provided with lining 37 which is a thin layer of a dry heat-insulating material prepared by mixing fine quartz sand and powdered theremosetting (bakelite) resin. To prepare the lining the above mixture is poured into a hopper (not shown) sealed with a cover and provided with sleeves and with a compressed air supply system (not shown in the drawing). Disposed under the hopper are pattern plates (not shown) with pattern halves (not shown) to which alternately secured the two half-moulds 12***a* and 12*b*, each of them being secured to a corresponding pattern. The extensions 14 and 15 of the half-moulds 12*a* and 12*b* accordingly are fitted with through holes (not shown) to which the hopper sleeves are connected.

The half-patterns and the corresponding half-moulds 12*a* and 12*b* are heated to a temperature ranging within 220°–250°C whereupon compressed air is fed into the hopper; as a result, the mixture enclosed in the hopper is forced at a pressure through the clearance between the internal surface of each half-mould 12*a* or 12*b* and the external surface of the pattern. After holding the pattern with the half-moulds 12*a* and 12*b* for 12 – 20 s, the half-moulds are coated with the layer of sintered mixture. On being removed from the patterns the half-moulds are heated to a temperature in a 350° – 370°C range to provide final hardening of the lining 37.

The lining might be as well prepared from other thermosetting resins and cold-hardening moulding sands or liquidglass $C0_2$-gas-hardened sands, etc., the methods of their usage and hardening conditions differing accordingly from that outlined above.

Upon placing the half-mould 12*a* and 12*b* on the disc 8 by making use of a centering depression 38 in each half-mould, the electric motor 19 is switched on and the disc 8 is brought into rotation through the pulley 22, belts 23, pulley 17 and vertical shaft 4. During rotation the metal bodies 32 and 33 of the centrifugal locks 24 and 25 are brought apart fastening together the half-moulds 12*a* and 12*b*. The weight of the revolving elements of the device is taken up by the thrust roller bearing 6 and the radial roller bearings 5 assist the shaft in keeping a vertical position.

Next a casting ladle (not shown) is carried to the metal mould and molten metal is poured through an opening into the metal mould 12 formed by semicylindrical grooves in the half-moulds 12*a* and 12*b*.

Figure 2:
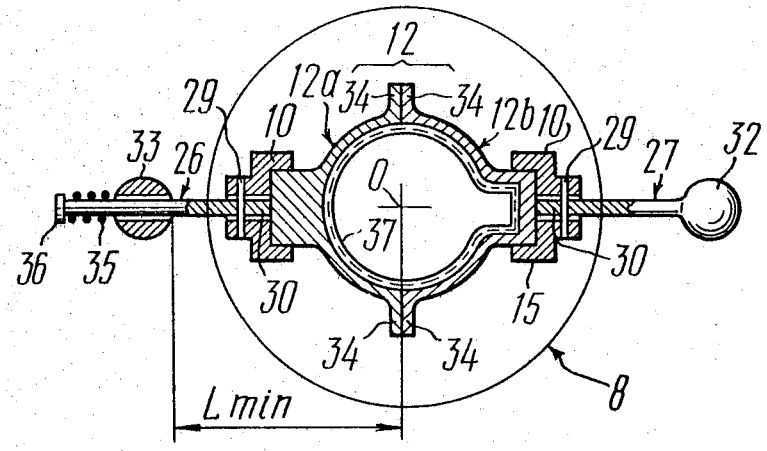
FIG. 2 is a schematic drawing of a metal mould and a revolving disc at the moment of pouring molten metal.

First portion of the molten metal poured on the bottom of the metal mould 12 will necessarily fill the cavity 13 in the half-mould 12*b* under the effect of centrifugal forces. This will cause a gradually progressing unbalance which should be duly compensated for. To this end from the moment the pouring process is initiated the speed of rotation of the shaft of the d.c. motor 19 is gradually increased by means of a rheostat (not shown). The spring 35 set up at the bottom end of the double-arm lever 26 is adapted to contract at a prescribed spinning speed of the disc 8. As soon as the above speed is attained, which occurs at the beginning of the pouring operation, the movable body 33 urges the spring 35 to contract, the body 33 moving as a result away from the spinning axis 00 along the bottom arm of the double-arm lever 26. During this travel of the movable metal body, the following occurs. The distance $l_{min}$ (FIG. 2) between the movable metal body 33 and the spinning axis 00 commences to increase reaching its maximum value $l_{max}$ at the moment the cavity 13 is completely filled with molten metal 39 (FIG. 3). Characteristic of the above period of the pouring cycle is a maximum unbalance, the movable metal body 33 offsetting this unbalance being thereby spaced at a maximum distance from the spinning axis 00. Further up to the end of the pouring of molten metal 39 into the metal mould 12 (FIG. 4) and then to the moment the spinning speed of the disc 8 starts decreasing after the metal of the hollow body being cast (not shown) has solidified, said distance $l_{max}$ does not change.

In case the molten metal is poured with the disc 8 revolving at a constant speed, i.e. when the effect of a change in the magnitude of the centrifugal force cannot be utilized to make the movable metal body 33 travel away from the spinning axis 00, it is expedient that a rod 40 disposed radially to the spinning axis 00 of the disc 8 and having a threaded side surface be fixed on the stay 10*a* (FIG. 5) diametrically opposite to the cavity (not shown) in the half-mould 12*b*. Fitted on the rod 40 is a metal movable body a weight 33*a* made as a nut. The fixed base plate 1 (FIG. 1) mounts a stationary electromagnet 41 (FIG. 5) disposed in the vicinity of the disc 8, with an electromagnet core 42 being arranged in parallel with the spinning axis 00 of said disc 8. As the cavity in the half-mould 12*b* is being filled with molten metal, a winding 43 of the electromagnet 41 is fed through terminals 44. Owing to an interaction between the electromagnet 41 and the bottom portion of the movable body 33*a* which is effected by virtue of an electromagnetic field, said portion is decelerated and a torque developed rotates the movable body 33*a*. In this case the movable body 33*a* travels along the rod 40 away from the spinning axis 00 offsetting the unbalanced produced.

The speed of displacement of the movable metal body 33*a* can be adjusted by interrupting the supply of electric current to the electromagnet 41. Another embodiment of the invention also provides for the compensation of the unbalance produced. In this embodiment a rod 45 disposed radially to the spinning axis 00 (FIG. 6) of the disc 8 is rigidly connected to the stay 10*a* and mounts a piston 46 immovable with respect to the rod 45. The piston 46 is accommodated in the movable metal body — weight 33*b* which is a hollow cylinder filled with fluid.

Both spaces 47 and 48 of the cylinder communicate with each other by means of a bypass line 49 on which is mounted a throttle 50 controlled by an electromagnet 51 set up on the disc 8. The electromagnet is energized through terminals 52.

In this case the value of opening of the throttle 50 determines the speed at which the fluid overflows from the space 48 adjacent the spinning axis 00 into the space 47 remote therefrom, said overflow being caused by centrifugal forces acting both on the removable metal body 33*b* and on the fluid accommodated within this body 33*b*. Under the effect of the centrifugal forces and due to the fluid overflowing along the bypass line 49 the movable body 33*b* will move away along the rod 45 from the spinning axis 00 offsetting thereby the unbalance.

To return the movable metal body 33*b* into its initial position provision is made for a spring 53 placed in the space 48 and striking with one its end against the wall of the hollow body 33*b* and with another against the piston 46. When the disc 8 stops, the spring 53 compressed due to the displacement of the movable metal body 33*b* away from the spinning axis 00 is released and carries the movable metal body 33*b* into its initial position towards the spinning axis 00.

In another embodiment of the present invention shown in FIG. 7 the movable metal body — weight 33*c* offsetting the unbalance is disposed on the same side of the spinning axis 00 as the cavity 13. The body 33*c* is freely fitted on a rod 54 fixed on the stay 10*a* adjacent to the cavity 13. The rod 54 is disposed radially to the spinning axis 00 of the metal mould 12*c*. On the free end of the rod 54 there is a boss 56 against which rests one end of a spring 55 fitted on said rod 54. Another end of the spring 55 strikes against the movable metal body 33 compressing the spring 55 at a relatively high spinning speed of the disc 8. At the beginning of the pouring of molten metal into the cavity 13 the spinning speed of the disc 8 decreases and the spring 55 on being released urges the movable metal body 33*c* to move to the spinning axis 00 offsetting thereby the unbalance produced (the final, i.e. nearest to the spinning axis 00, position of the movable metal body 33*c* is shown with dotted line).

In mass production of hollow metal bodies with asymmetrical cross-section a plurality of the devices of this invention can be mounted on a rotary casting machine.

What we claim is:

1. A device for centrifugal casting of a hollow body with asymmetrical cross-section comprising a fixed base plate; a revolving disc adapted to have constant speed and mounted revolvably on said fixed base plate; a rod fixed on a stay so that it is disposed radially to the spinning axis of said revolving disc; a piston carried by said rod; a cylinder filled with fluid and accommodating said piston; said cylinder having spaces separated by said piston but in communication with one another along a by-pass line; said cylinder acting as a counterbalance weight traveling under the effect of centrifugal forces when a throttle on said by-pass line opens so as to facilitate movement of fluid and cylinder to and away from the spinning axis; a metal mould provided with lining and set up on said revolvable disc so that the longitudinal axis of this mould is essentially coaxial with the spinning axis of said revolvable disc; a cavity in said metal mould causing a progressing unbalance of the device as the cavity becomes filled with molten metal; said throttle adapted to open at the moment said cavity in said metal mould is being filled with said molten metal causing said unbalance; and electric motor means for rotating said revolvable disc.

* * * * *